US007915549B2

(12) United States Patent
Okidate

(10) Patent No.: US 7,915,549 B2
(45) Date of Patent: Mar. 29, 2011

(54) MULTIDIRECTIONAL OPERATION SWITCH APPARATUS

(75) Inventor: Toru Okidate, Saitama (JP)

(73) Assignee: Calsonic Kansei Corporation, Saitama (JP)

( * ) Notice: Subject to any disclaimer, the term of this patent is extended or adjusted under 35 U.S.C. 154(b) by 337 days.

(21) Appl. No.: 12/292,743

(22) Filed: Nov. 25, 2008

(65) Prior Publication Data

US 2009/0134003 A1 May 28, 2009

(30) Foreign Application Priority Data

Nov. 28, 2007 (JP) ..... 2007-306770

(51) Int. Cl.
*H01H 3/00* (2006.01)

(52) U.S. Cl. ..... 200/18; 200/6 A

(58) Field of Classification Search ..... 200/18
See application file for complete search history.

(56) References Cited

U.S. PATENT DOCUMENTS 4,245,137 A * 1/1981 Hirai et al. ..... 200/4
5,047,596 A * 9/1991 Ebishi ..... 200/6 A

FOREIGN PATENT DOCUMENTS

| | | |
|---|---|---|
| JP | 6-283075 | 10/1994 |
| JP | 2001-109558 | 4/2001 |
| JP | 3083070 | 10/2001 |
| JP | 2003-308759 | 10/2003 |
| JP | 2005-317377 | 11/2005 |
| JP | 2008-041531 | 2/2008 |

* cited by examiner

*Primary Examiner* — Renee S Luebke
*Assistant Examiner* — Lisa Klaus
(74) *Attorney, Agent, or Firm* — Wenderoth, Lind & Ponack, L.L.P.

(57) ABSTRACT

In a multidirectional operation switch apparatus, a rotary switch is switched on by rotating a dial, and push switches are switched on by sliding the dial in multidirections by means of a sliding section. The sliding section is made of a single constituting member. The sliding section is provided on an upper surface thereof with an upper rail part which slides a pad in X direction (direction of arrow "c-d"; FIG. 3), and is provided on a lower surface thereof with a lower rail part which slides the pad supported by the sliding section in Y direction (direction of arrow "a-b").

4 Claims, 9 Drawing Sheets

MULTIDIRECTIONAL OPERATION SWITCH APPARATUS

CROSS REFERENCE TO RELATED APPLICATIONS

The present application is based on and claims priority from Japanese Application Number 2007-306770, filed on Nov. 28, 2007, the disclosure of which is hereby incorporated by reference herein in its entirety.

BACKGROUND OF THE INVENTION

1. Field of the Invention

The present invention relates to a multidirectional operation switch apparatus which is used, e.g., in a car navigation system in performing a scroll operation of the displays on a screen thereof.

2. Description of the Related Art

Conventionally, a multidirectional operation switch apparatus is used in a car navigation system in order to perform scroll operation and the like of the displays on a screen (as a related art, see, e.g., JP-A-2008-41531). In this related art, the multidirectional operation switch apparatus 16 is supported on an upper surface of a base member 19 through slide plates 22, 23 in a manner to be slidable in X and Y directions.

On the other hand, a first substrate 17 is provided with push switches 18, which are arranged to be switched on by a push movement of a pad member 24. There is fixed to the pad member 24 a second substrate 27, which is provided with a rotary switch 33 so as to be rotatable clockwise or counterclockwise. This rotary switch 33 is arranged to be switched on as a result of rotary operation of a dial operation part 32.

In the conventional multidirectional operation switch apparatus 16, the pad member 24 is simply supported on the base member 19 through slide plates 22, 23 and are, thus, not firmly fixed. As a result, when the rotary switch 33 is rotated clockwise or counterclockwise by the dial operation member 32, there occurs clattering in the direction of rotation. Therefore, the rotation cannot be started smoothly, thereby resulting in a poor feeling of touching or operability.

SUMMARY OF THE INVENTION

In view of the problems associated with the prior art, the invention has an object of providing a multidirectional operation switch apparatus which is superior in the feeling of touching at the time of rotary operation thereof.

According to this invention, there is provided a multidirectional operation switch apparatus comprising: a first substrate having disposed thereon a plurality of push switches; and an operation unit supported on an upper surface of the first substrate through a mechanism unit so as to be slidable in X, Y direction, the push switches being so arranged as to be switched on by a push movement of the operation unit. The mechanism unit comprises: a second substrate having disposed thereon a rotary switch which is rotatable by the operation unit clockwise or counterclockwise; a pad for fixedly supporting the second substrate; and a base fixed to the first substrate. The base supports the pad through a sliding section. The sliding section is formed of a single member and comprises: an upper rail part disposed on an upper surface of the sliding section; and a lower rail part disposed on a lower surface of the sliding section. The upper rail part slidably movies the pad in one of the X, Y directions, and the lower rail part slidably moves the pad on an upper surface of the base in the other of the X,Y directions.

In the multidirectional operation switch apparatus according to the invention, the sliding section is formed of a single member. Therefore, the sliding section according to this invention does not have an overlapping construction contrary to the construction in the prior art. In this manner, the pad is stably supported on the base. As a result, when a passenger on a vehicle tries to rotate the rotary switch, there occurs no clattering in the direction of rotation of the rotary switch, whereby the rotary switch can be started smoothly. The apparatus of this invention is thus superior in the feeling of touching at the time of rotary operation thereof.

In addition, according to the multidirectional operation switch apparatus of this invention, the sliding section is formed of a single member as described above. Therefore, as compared with the conventional one, the number of constituent elements can be reduced, resulting in a reduction in manufacturing costs.

Furthermore, since the sliding section is formed of a single member in the apparatus of the invention, the assembling work becomes easier as compared with the conventional one, resulting in an improved manufacturing efficiency.

DETAILED DESCRIPTION OF THE PREFERRED EMBODIMENTS

A description will now be made about the preferred embodiments of the invention with reference to the accompanying drawings.

Figure 1:
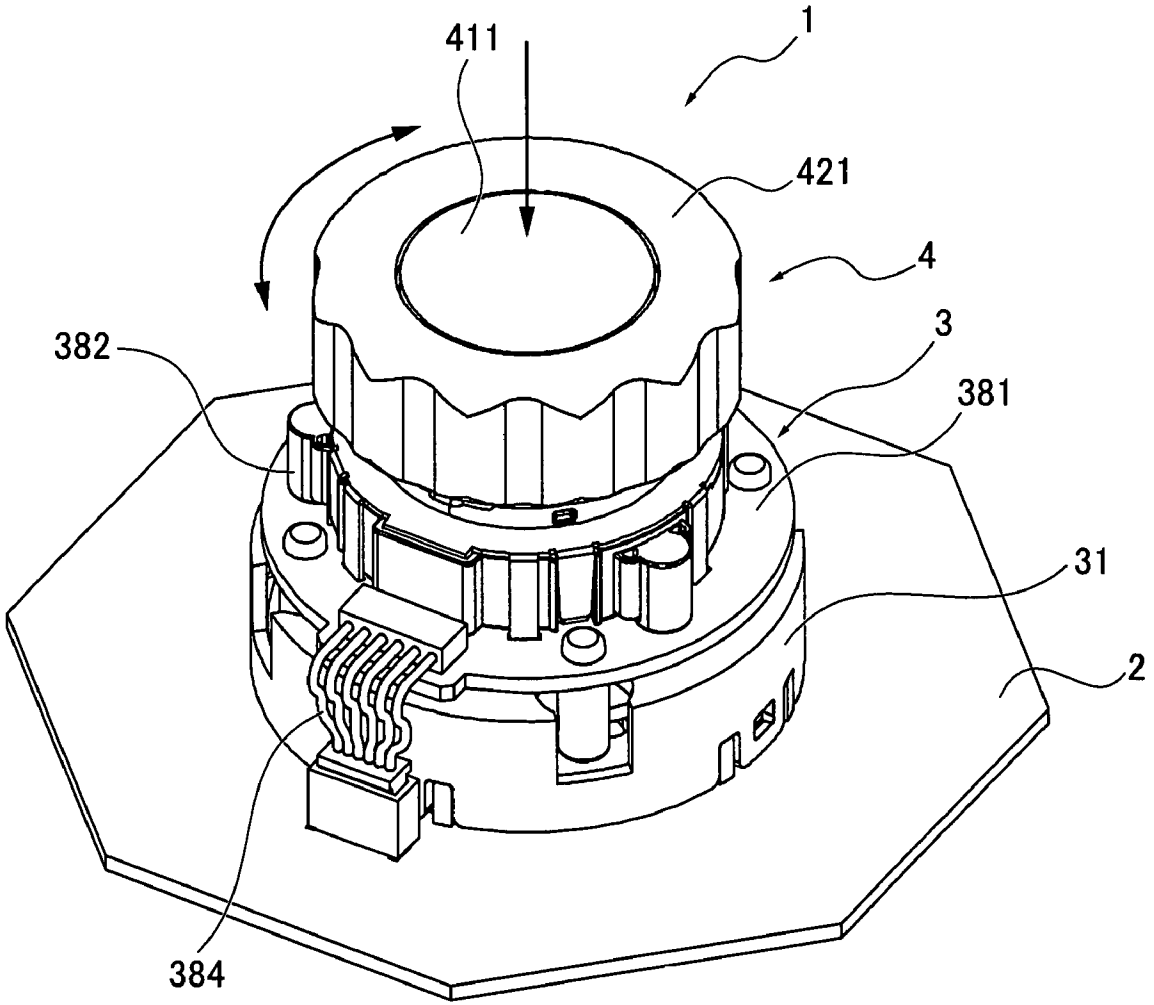
FIG. 1 is an outside perspective view of a multidirectional operation switch apparatus according to an embodiment of this invention.
Figure 2:
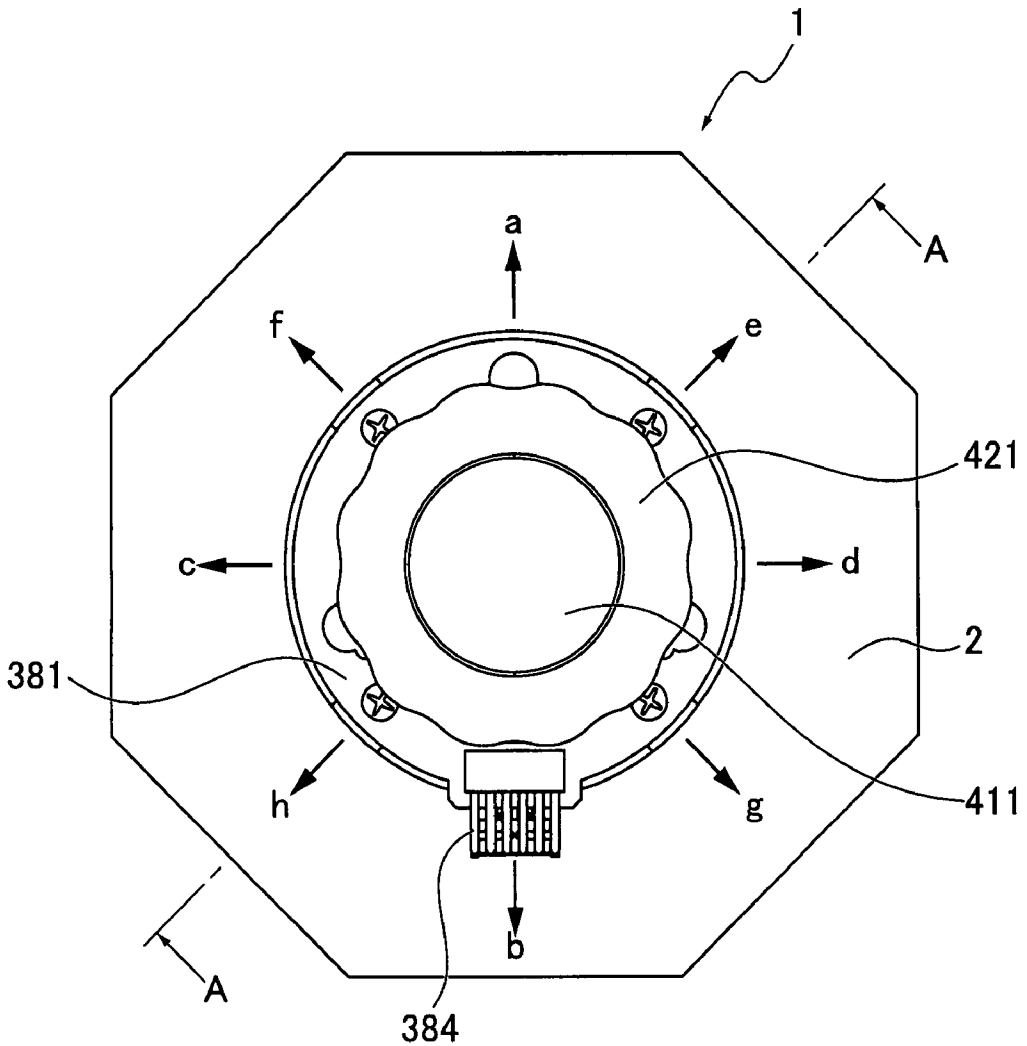
FIG. 2 is a plan view of a multidirectional operation switch apparatus according to an embodiment of this invention.

FIG. 1 is an external perspective view of a multidirectional operation switch apparatus 1 showing an embodiment of the invention. The multidirectional operation switch apparatus 1 is used in inputting operation in a navigation system for a vehicle. Specifically, the multidirectional operation switch apparatus 1 is arranged to be capable of performing rotational operation, pushing operation, and sliding operation in multiple directions. Multiple directions are, as shown in FIG. 2, eight directions in all, i.e., an upper direction "a", a lower direction b, a left direction c, a right direction d, a diagonally right upper direction e, a diagonally left upper direction f, a diagonally right lower direction g, and a diagonally left lower direction h. Further, as shown in FIG. 3, the multidirectional operation switch apparatus 1 is provided with a first substrate 2, a mechanism unit 3, and an operation unit 4.

Figure 4:
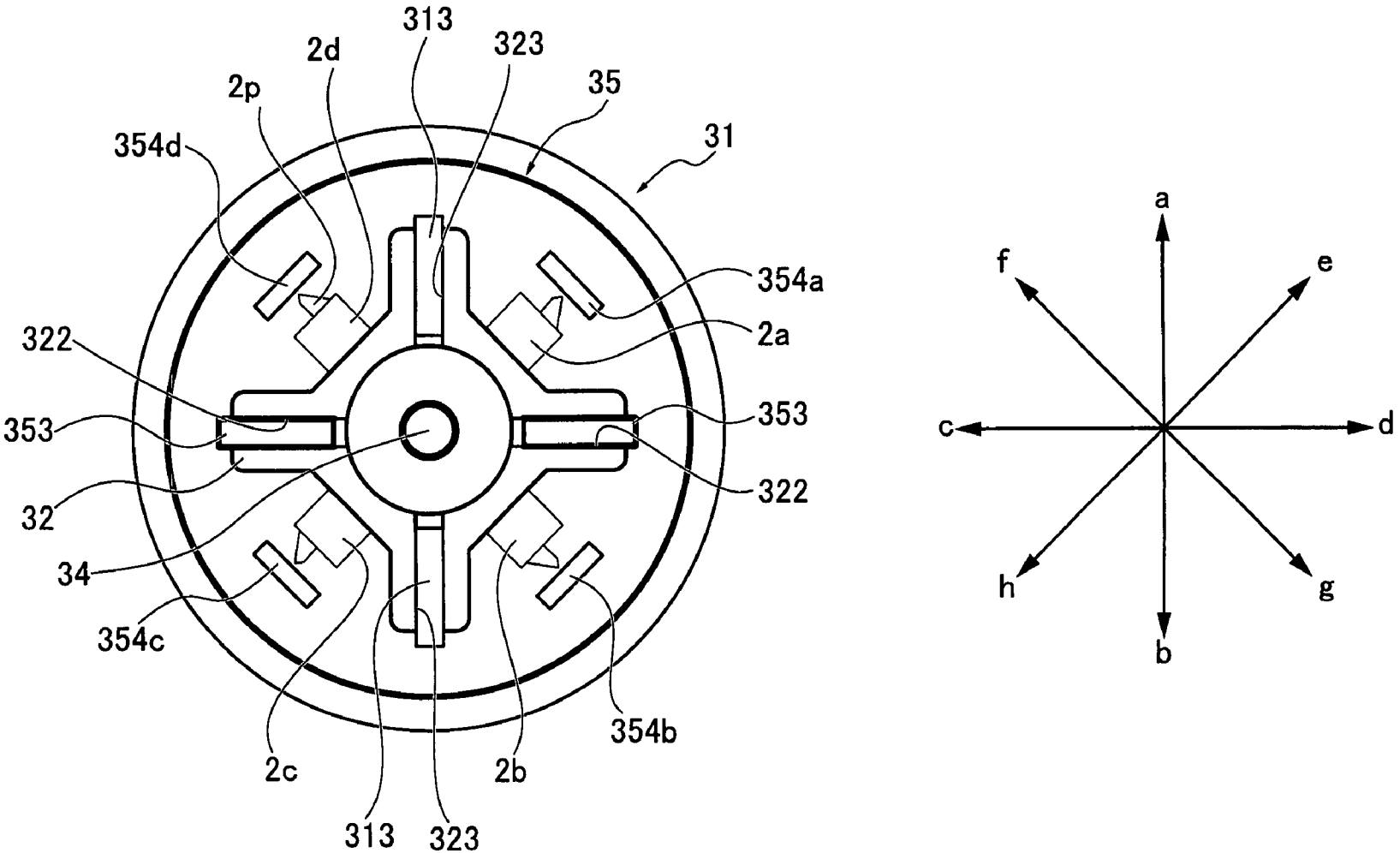
FIG. 4 is a schematic view of an essential portion in a state in which the pad is in a neutral position in the multidirectional operation switch apparatus according to the embodiment of this invention.

First, a description will be made about the first substrate 2. The first substrate 2 has, in its central portion, a supporting hole 21 and is provided on its upper surface with four push switches 2*a*-2*d*, which are disposed around the supporting hole 21. Specifically, the four push switches 2*a*-2*d* are disposed, as shown in FIG. 4, in the diagonally right upper position e, the diagonally left lower position h, the diagonally left upper position f and the diagonally right lower position g.

Figure 3:
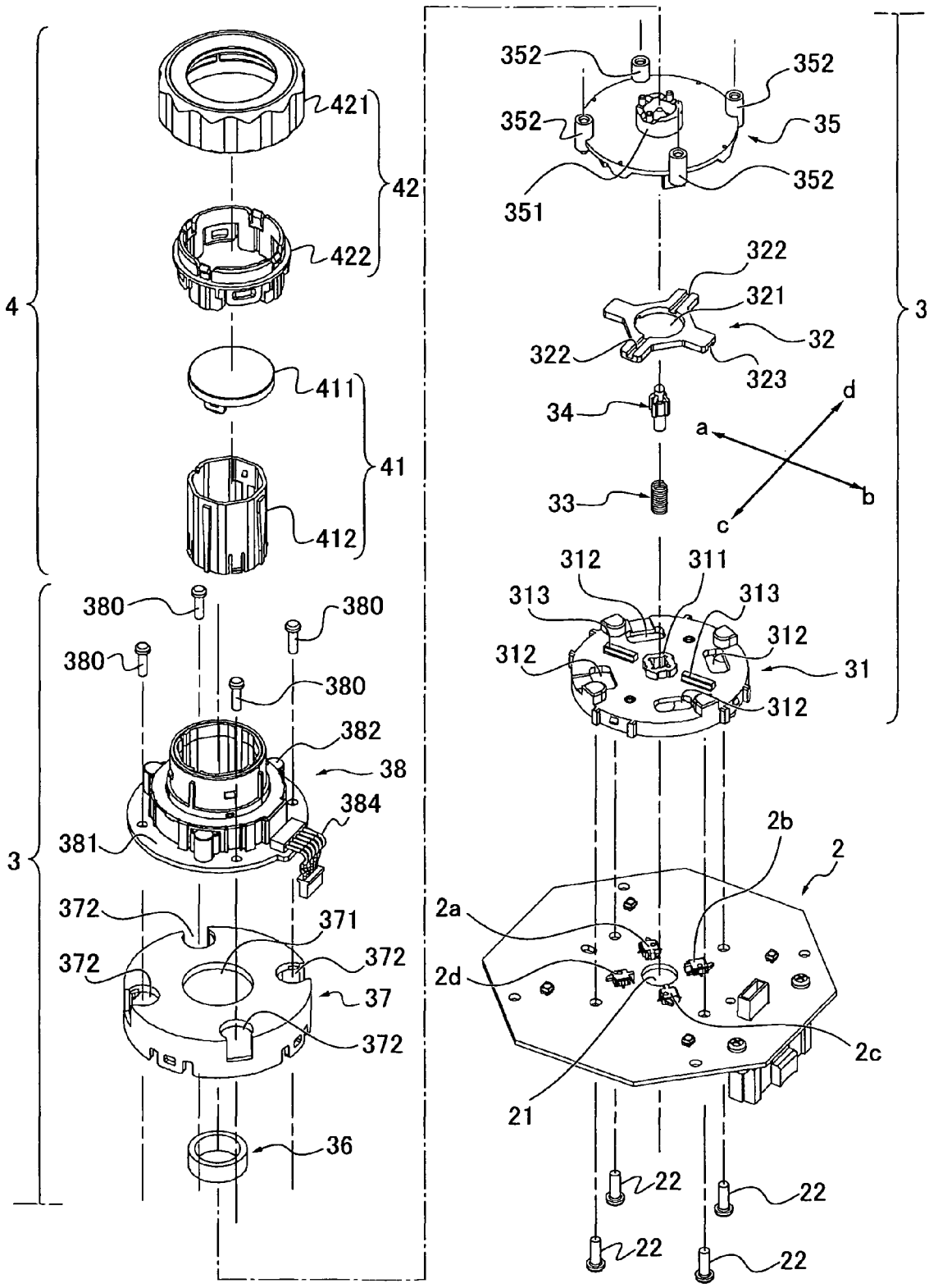
FIG. 3 is an exploded perspective view of a multidirectional operation switch apparatus according to the embodiment of this invention.

Next, as shown in FIG. 3, the mechanism unit 3 is provided with a base 31, a sliding section 32, a spring 33, a supporting pin 34, a pad 35, a damper 36, a base cover 37, and a second substrate 38.

Figure 5:
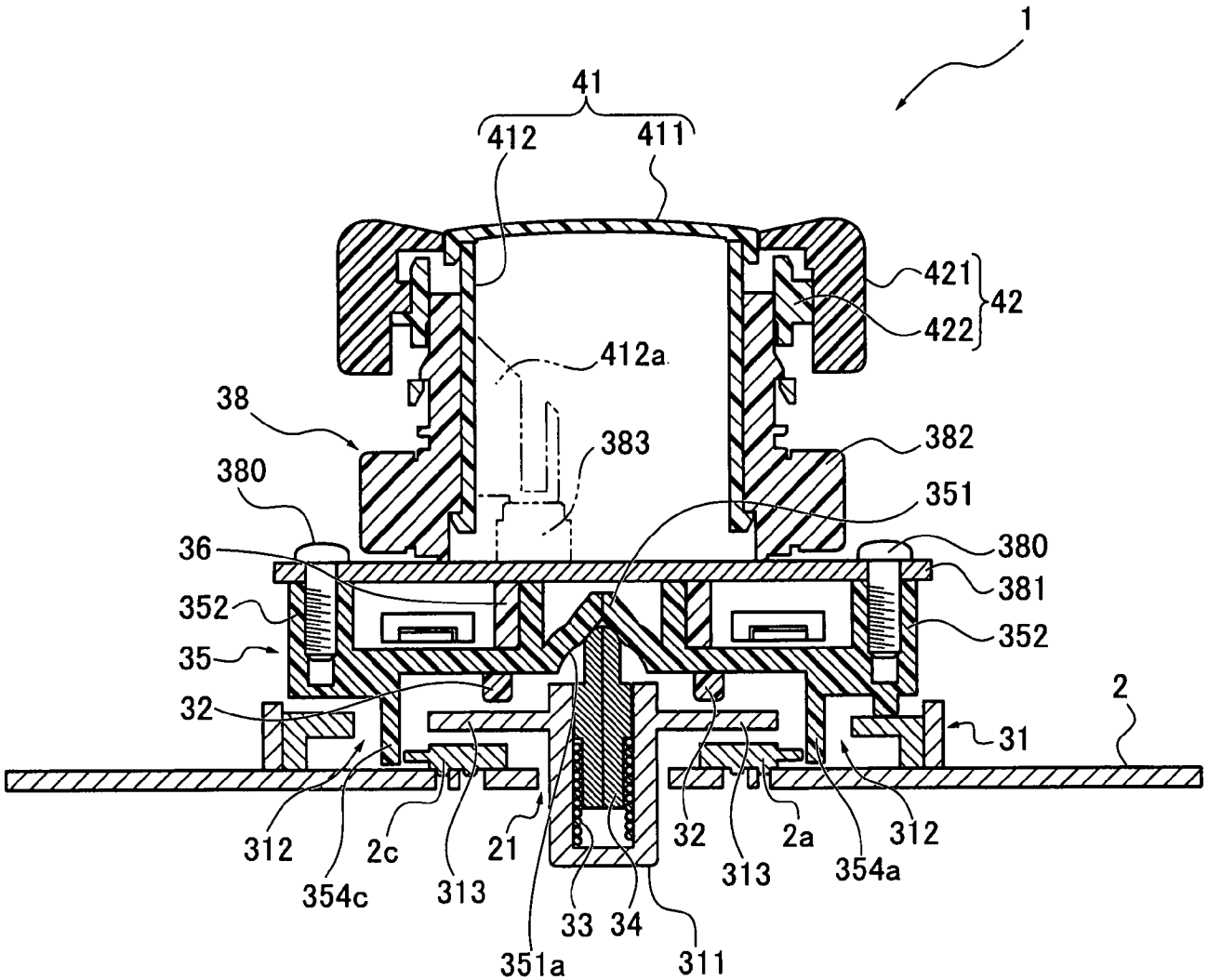
FIG. 5 is a sectional view taken along the line A-A in FIG. 2.

The base 31 is fixed to the upper surface of the first substrate 2 by means of a plurality of screws 22, and is formed into the shape of a circular cap so as to cover the four push switches 2*a*-2*d*. As shown in FIG. 5, the base 31 has in its central portion a fitting part 311 which is formed into a cylindrical shape with its upper surface left open. In addition, the fitting part 311 is formed in a manner to project downward from the base 31 and is fitted into the supporting hole 21 in the first substrate 2.

In addition, as shown in FIG. 3, the base 31 is provided on its upper surface with four slots 312 and two rail parts 313. Each of the slots 312 is disposed to correspond to each of the push switches 2*a*-2*d*. Further, each of the slots 312 is elongated in a circumferential direction such that a tip part of each of the push switches is exposed (see FIG. 4). Two rail parts 313, on the other hand, are formed in a projected manner and are disposed so as to extend in the Y direction (the direction of an arrow "a-b").

Next, as shown in FIG. 3, the sliding section 32 is made up of a single member. More specifically, the sliding section 32 is in the form of a thin plate of a cross shape and is provided, in the central portion thereof, with a through hole 321. The sliding section 32 has on its upper surface two upper rail parts 322, which are formed into grooves and are disposed so as to extend in the X direction (direction of arrow "c-d") with the through hole 321 positioned in the center thereof.

As shown in FIGS. 3 and 4, the sliding section 32 has on its lower surface two lower rail parts 323, which are so disposed as to extend in the Y direction (direction of arrow "a-b") with the through hole 321 positioned in the center thereof. The two lower rail parts 323 are formed into grooves and are externally fitted into (i.e., fitted onto the outside of) the two rail parts 313 which are in projected shape. According to this arrangement, the sliding section 32 is supported on the base 31 in a manner to be slidable in the Y direction (direction of arrow "a-b").

A description will now be made about the spring 33 and the supporting pin 34. The spring 33 is arranged to be extendible in the vertical direction. As shown in FIG. 5, the supporting pin 34 is internally fitted into (i.e., fitted into the inside of) the spring 33. In this state, the supporting pin 34 is inserted into the through hole 321 as shown in FIG. 3. As shown in FIG. 5, the lower part of the supporting pin 34 is inserted into the fitting part 311 of the base 31.

Now, the pad 35 is formed into a circular shape and is provided in its central portion with a pin receiving part 351, which is formed in a manner to project upward from the upper surface of the pad 35. The pin receiving part 351 is provided, as shown in FIG. 5, with a recessed part 351*a* on the lower surface thereof. The recessed part 351*a* is formed into a funnel shape so that an upper end of the supporting pin 34 comes into contact with the central portion of the recessed part 351*a*. In this manner, the pad 35 is so arranged as to be slidably movable (to be movable by sliding) in diagonal directions as a result of shifting the contact position of the supporting pin 34.

As shown in FIG. 3, the pad 35 is provided in its periphery with a plurality of screw fixing parts 352 (parts to be fixed by means of screws). Each of the screw fixing parts 352 is formed into a cylindrical shape with its upper end left open. As shown in FIG. 4, the pad 35 is further provided in its lower surface with two rail parts 353 and four switch pushing parts 354*a*-354*d*.

The two rail parts 353 are disposed to correspond to the upper rail part 322 of the sliding section 32. More specifically, the two rail parts 353 are disposed so as to extend in the X direction (direction of arrow "c-d") with the pin receiving part 351 positioned therebetween. The two rail parts 353 are formed in projected shape and are internally fitted into (or are fitted into the inside of) the two upper rail parts 322, which are in grooved shape, in the sliding section 32. According to this arrangement, the pad 35 is supported on the base 31 so as to be slidably movable in the X direction (direction of arrow "c-d") through the sliding section 32 (see FIG. 3). Further, because the sliding section 32 is supported by the base 31 in a manner to be slidable in the Y direction (direction of arrow "a-b"), the pad 35 is supported by the base 31 through the sliding section 32 so as to be slidable in the Y direction (direction of arrow "a-b").

The four switch pushing parts 354*a*-354*d* are oppositely positioned along the line between the diagonally right upper point e and the diagonally left lower point h, as well as along the line between the diagonally left upper point f and the diagonally right lower point g, with the pin receiving part 351 being positioned therebetween (see FIG. 3). Each of the switch pushing parts 354*a*-354*d* is formed into a projection so as to be inserted through each of the slots 312 (see FIG. 3) to the neighborhood of the tip end 2*p* of each of the push switches 2*a*-2*d*.

The damper 36 is formed into a ring and is fitted onto the outside of the pin receiving part 351 of the pad 35. According to this arrangement, the damper 36 prevents the vibrations from the upper side, from being transmitted to the pin receiving part 351.

Now, the base cover 37 is formed into a circular cup shape and is supported by the pad 35 in a manner to cover the pad 35. More specifically, the base cover 37 is provided in the central portion thereof with a supporting hole 371, which receives the damper 36 by fitting it into the supporting hole 371. The base cover 37 is provided in its periphery with a plurality of through holes 372. Each of the through holes 372 receives the screw fixing part 352 therethrough.

The second substrate 38 is provided with a substrate main body 381, a rotary switch 382, and a push switch 383 (shown in dotted lines in FIG. 5). The substrate main body 381 is supported on the pad 35 through the base cover 37 and is fixed, in this state, to the pad 35 by means of a plurality of screws 380. The substrate main body 381 is connected, as shown in FIG. 1, to the circuit portion of the first substrate 2 through cables 384. The rotary switch 382 is formed into a cylindrical shape and is connected to the substrate main body 381 in a state of being rotatable. As shown in FIG. 5, the push switch 383 is disposed inside the rotary switch 382 and is connected to the substrate main body 381.

A description will now be made about the operation unit 4. As shown in FIG. 3, the operation unit 4 is provided with a push operation section 41 and a rotary operation section 42.

The push operation section 41 is provided with a push button 411 and a button guide part 412. The button guide part 412 is formed into a cylindrical shape and is supported in a manner to be movable up and down inside the rotary switch 382. As shown in FIG. 5, the button guide part 412 is provided inside thereof with a switch pushing part 412*a*, which is in abutment with the upper surface of the push switch 383. The push button 411 is fitted into the upper end of the button guide part 412 in a manner to close the opening on the upper surface of the button guide part 412.

As shown in detail in FIG. 3, the rotary operation section 42 is provided with a dial 421 and a dial guide part 422. The dial guide part 422 is formed into a cylindrical shape. As shown in FIG. 5, the dial guide part 422 is fitted onto the outside of the rotary switch 382. As shown in FIG. 3, the dial 421 is formed into a ring. Further, as shown in FIG. 5, the dial 421 is fitted onto the dial guide part 422 in a state in which the push button 411 is disposed inside.

A description will now be made about an example in which the multidirectional operation switch apparatus 1 is used for inputting operation in a car navigation apparatus. In selecting an arbitrary menu out of a plurality of menus displayed on the operation screen, the passenger operates the rotary switch 382 by rotating the dial 421 clockwise or counterclockwise as shown in FIG. 1. As a result, the rotary switch 382 is switched on and a switching signal is outputted. Based on this switching signal, the cursor on the screen will be moved so that an arbitrary menu can be selected.

Then, the push button 411 is pushed for operation as shown in FIG. 1. As a result, the button guide part 412 is depressed so that the push switch 383 is switched on by means of the switch pushing part 412*a*, thereby confirming the selected menu. Thereafter, when the passenger releases the push button 411, the push button 411 returns to the original position.

Here, the multidirectional operation switch apparatus 1 is so arranged that the sliding section 32 is formed of a single member. Since the multidirectional operation switch apparatus 1 has consequently no construction in which the sliding section is overlapped as is the case with the conventional multidirectional operation switch apparatus, the pad 35 is stably supported on the base 31. As a result, when the passenger rotates the rotary switch 382, there will occur no clattering in the direction of rotation, thereby assuring a smooth starting of rotation. In this manner, the multidirectional operation switch apparatus 1 improves the feeling of touching the rotary switch 382 at the time of rotational operation.

In addition, since the multidirectional operation switch apparatus 1 is so arranged that the sliding section 32 is formed of a single member, the number of constituent parts decreases as compared with the conventional multidirectional operation switch apparatus, resulting in a reduction in manufacturing cost. Furthermore, by forming the sliding section 32 in a single piece, the multidirectional operation switch apparatus 1 is easier in assembling, resulting in an improved manufacturing efficiency.

Still furthermore, since the sliding section 32 is made of a thin plate member, the overall height of the apparatus 1 can be reduced. As a result, there can be constituted a multidirectional operation switch apparatus having a mechanism unit 3 which is multifunctional and larger in size within a limited housing space. As a result, the multidirectional operation switch apparatus 1 can contribute to improved functionality and space saving.

In addition, since the multidirectional operation switch apparatus 1 is so arranged that the upper rail part 322 and the lower rail part 323 of the sliding section 32 are formed into grooves, the apparatus 1 can be kept to a still smaller overall height, resulting in a small size of the apparatus 1.

In trying to scroll the screen which displays a map, the passenger moves the dial 421 by sliding it in one of the eight directions (directions of arrows "a-h") as shown in FIG. 2. A description will now be made about the operation of the dial 421 by sliding it in each of the directions.

First, when the dial 421 is in a position not operated by sliding (i.e., in a neutral position), the sliding section 32 is positioned in the central portion of the base 31. Each of the switch pushing parts 354*a*-354*d* of the pad 35 is away from each of the push switches 2*a*-2*d* and consequently the push switches 2*a*-2*d* remain switched off.

Figure 6:
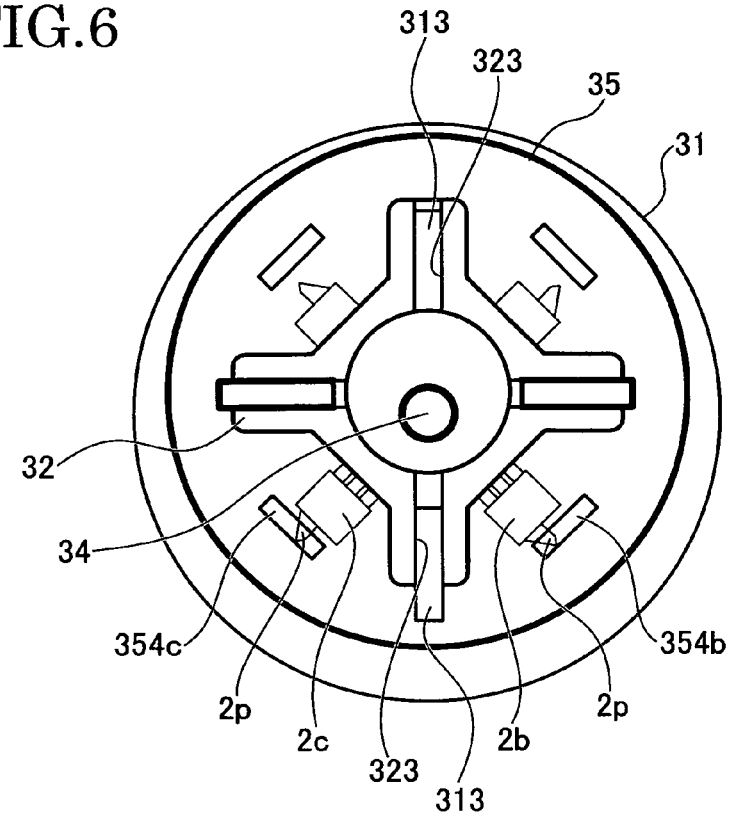
FIG. 6 is a schematic view in which the pad has moved by sliding in an upper direction from the position in FIG. 4.

In a case where the dial 421 is operated to slide it from the position as shown in FIG. 2 in the upper direction "a," the pad 35 moves, as shown in FIGS. 4 and 6, to the upper side in a state in which, while pushing the supporting pin 34, the two lower rail parts 323 of the sliding section 32 are guided by the two rail parts 313 of the base 31.

As shown in FIG. 6, once the pad 35 moves to the upper side, each of the two lower switch pushing parts 354*b*, 354*c* pushes respective tips 2*p* of the two push switches 2*b*, 2*c* on the lower side of the first substrate 2, whereby these push switches 2*b*, 2*c* are switched on. When the state in which the supporting pin 34 is pushed by the pad 35 is released, the spring 33 returns to the original state, and the pad 35 returns to the neutral position as shown in FIG. 4.

Figure 7:
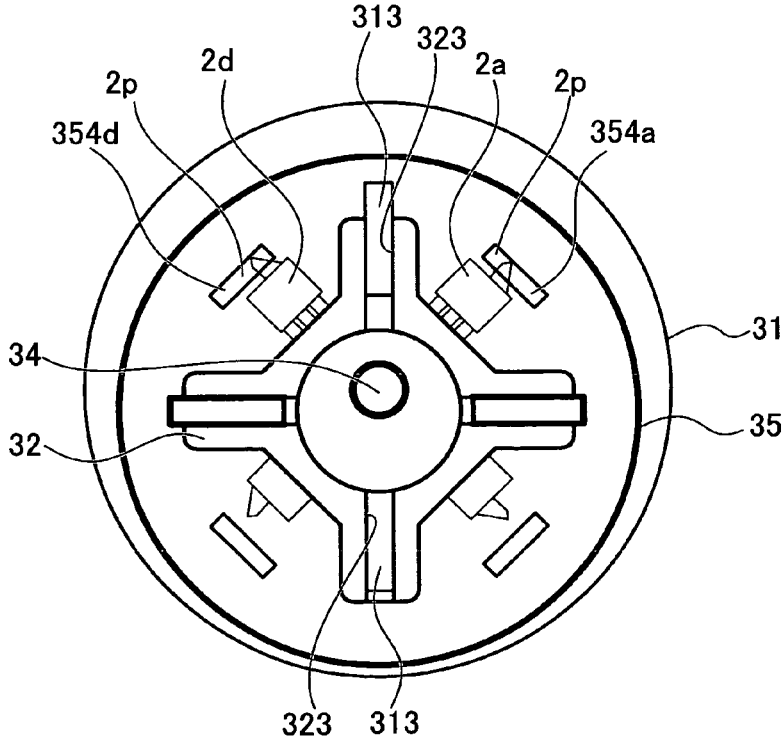
FIG. 7 is a schematic view in which the pad has moved by sliding in a lower direction from the position in FIG. 4.

In a case where the dial 421 is operated to slide it from the position as shown in FIG. 2 in the lower direction b, the pad 35 moves, as shown in FIGS. 4 and 7, to the lower side in a state in which, while pushing the supporting pin 34, the two lower rail parts 323 of the sliding section 32 are guided by the two rail parts 313 of the base 31.

As shown in FIG. 7, once the pad 35 moves to the lower side, each of the two upper switch pushing parts 354*a*, 354*d* of the pad 35 respectively pushes the tip of two push switches 2*a*, 2*d* on the upper side of the first substrate 2, whereby these push switches 2*a*, 2*d* are switched on. When the state in which the supporting pin 34 is pushed by the pad 35 is released, the spring 33 returns to the original state, and the pad 35 returns to the neutral position as shown in FIG. 4.

Figure 8:
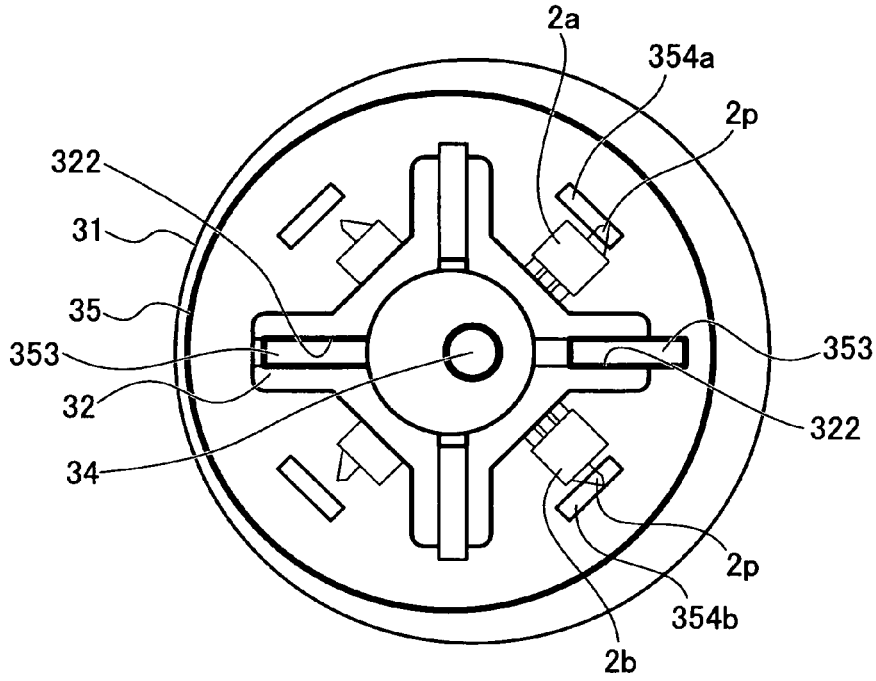
FIG. 8 is a schematic view in which the pad has moved by sliding in a left direction from the position in FIG. 4.

In a case where the dial 421 is operated to slide it from the position as shown in FIG. 2 in the left direction c, the pad 35 moves, as shown in FIGS. 4 and 8, to the left side in a state in which, while pushing the supporting pin 34, the two lower rail parts 323 of the sliding section 32 are guided by the two rail parts 313 of the base 31.

When the pad 35 moves to the left side as shown in FIG. 8, each of the two upper switch pushing parts 354*a*, 354*b* of the pad 35 pushes the tip of the two push switches 2*a*, 2*b* on the right side of the first substrate 2, whereby these push switches 2*a*, 2*b* are switched on. When the state in which the supporting pin 34 is pushed by the pad 35 is released, the spring 33 returns to the original state, and the pad 35 returns to the neutral position as shown in FIG. 4.

Figure 9:
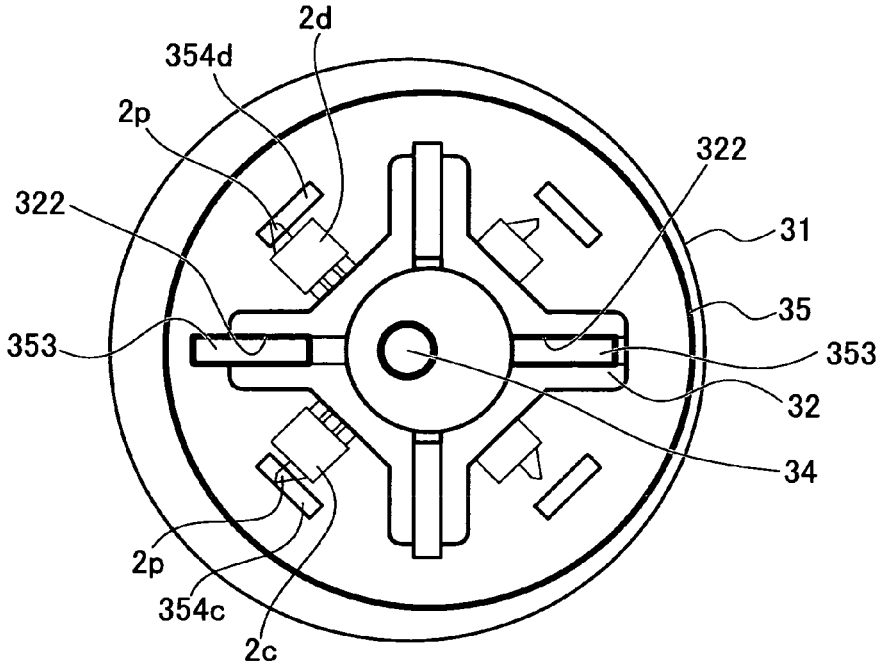
FIG. 9 is a schematic view in which the pad has moved by sliding in a right direction from the position in FIG. 4.

In a case where the dial 421 is operated to slide it from the position as shown in FIG. 2 in the right direction d, the pad 35 moves, as shown in FIGS. 4 and 9, to the right side in a state in which, while pushing the supporting pin 34, the two lower rail parts 323 of the sliding section 32 are guided by the two rail parts 313 of the base 31.

When the pad 35 moves to the right side as shown in FIG. 9, each of the two switch pushing parts 354*c*, 354*d* on the left side of the first substrate 2 pushes each of the tips 2*p* of the two push switches 2*c*, 2*d* on the left side of the first substrate 2, whereby these push switches 2*c*, 2*d* are switched on. When the state in which the supporting pin 34 is pushed by the pad 35 is released, the spring 33 returns to the original state, and the pad 35 returns to the neutral position as shown in FIG. 4.

Figure 10:
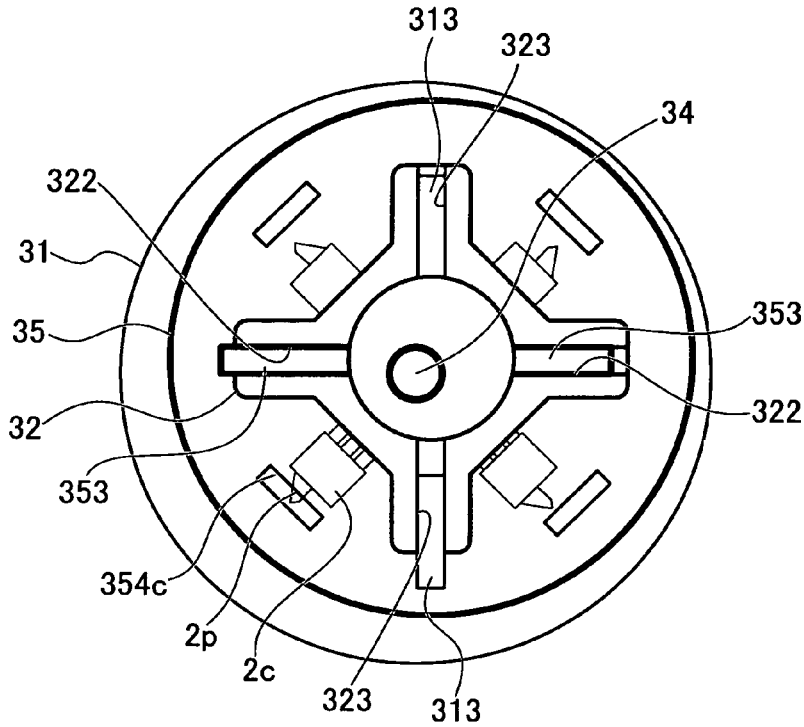
FIG. 10 is a schematic view in which the pad has moved by sliding in a diagonally right upper direction from the position in FIG. 4.

In a case where the dial 421 is operated to slide it from the position as shown in FIG. 2 in the diagonally right upper direction e, the pad 35 moves, as shown in FIGS. 4 and 10, to the diagonally right upper side in a state in which, while pushing the supporting pin 34, the two lower rail parts 323 of the sliding section 32 are guided by the two rail parts 313 of the base 31.

When the pad 35 moves to the diagonally right upper side as shown in FIG. 10, the switch pushing part 354*c* on the left lower side of the first substrate 2 pushes the tip 2*p* of the push switch 2*c* on the left lower side of the first substrate 2, whereby this push switch 2*c* is switched on. When the state in which the supporting pin 34 is pushed by the pad 35 is released, the spring 33 returns to the original state, and the pad 35 returns to the neutral position as shown in FIG. 4.

Figure 11:
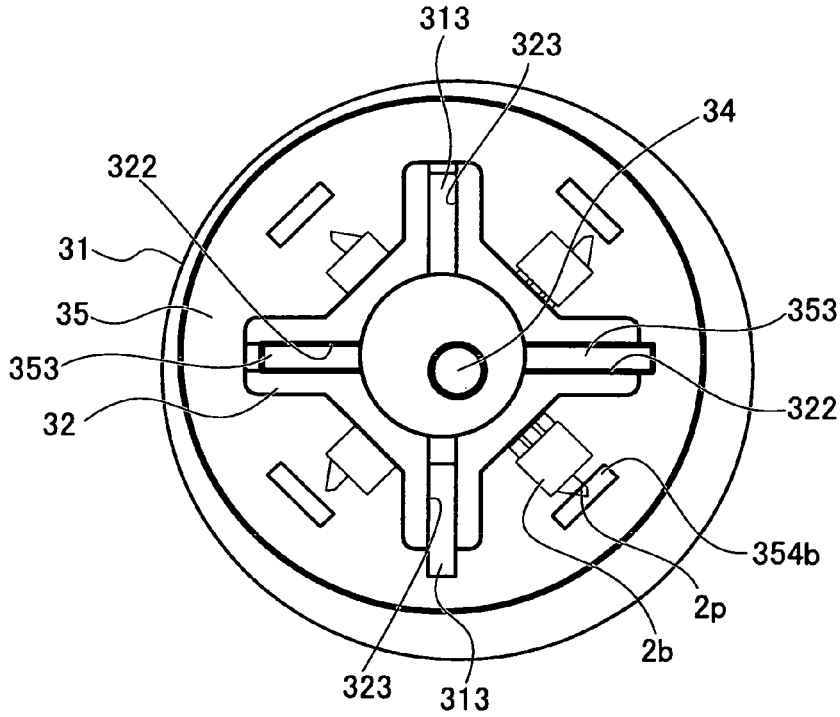
FIG. 11 is a schematic view in which the pad has moved by sliding in a diagonally left upper direction from the position in FIG. 4.

In a case where the dial 421 is operated to slide it from the position as shown in FIG. 2 in the diagonally left upper direction f, the pad 35 moves, as shown in FIGS. 4 and 11, to the diagonally left upper side in a state in which, while pushing the supporting pin 34, the two lower rail parts 323 of the sliding section 32 are guided by the two rail parts 313 of the base 31.

When the pad 35 moves to the diagonally left upper side as shown in FIG. 11, the switch pushing part 354*b* on the right lower side of the pad 35 pushes the tip 2*p* of the push switch 2*b* on the right lower side of the first substrate 2, whereby this push switch 2*b* is switched on. When the state in which the supporting pin 34 is pushed by the pad 35 is released, the spring 33 returns to the original state, and the pad 35 returns to the neutral position as shown in FIG. 4.

Figure 12:
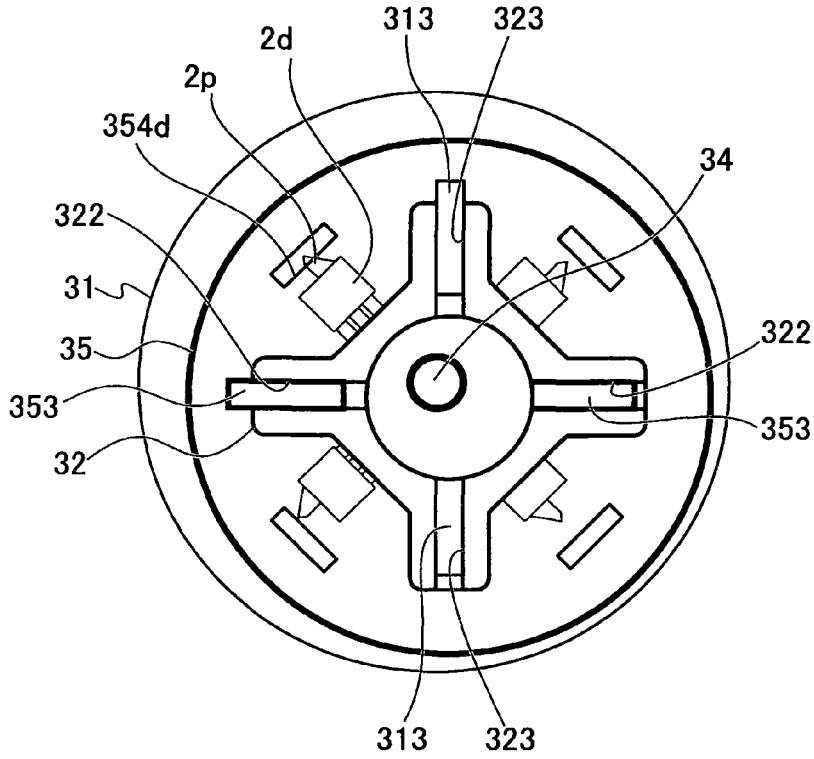
FIG. 12 is a schematic view in which the pad has moved by sliding in a diagonally right lower direction from the position in FIG. 4.

In a case where the dial 421 is operated to slide it from the position as shown in FIG. 2 in the diagonally right lower direction g, the pad 35 moves, as shown in FIGS. 4 and 12, to the diagonally right lower side in a state in which, while pushing the supporting pin 34, the two lower rail parts 323 of the sliding section 32 are guided by the two rail parts 313 of the base 31.

When the pad 35 moves to the diagonally right lower side as shown in FIG. 12, the switch pushing part 354*d* on the left upper side of the first substrate 2 pushes the tip 2*p* of the push switch 2*d* on the left upper side of the first substrate 2, whereby this push switch 2*d* is switched on. When the state in which the supporting pin 34 is pushed by the pad 35 is released, the spring 33 returns to the original state, and the pad 35 returns to the neutral position as shown in FIG. 4.

Figure 13:
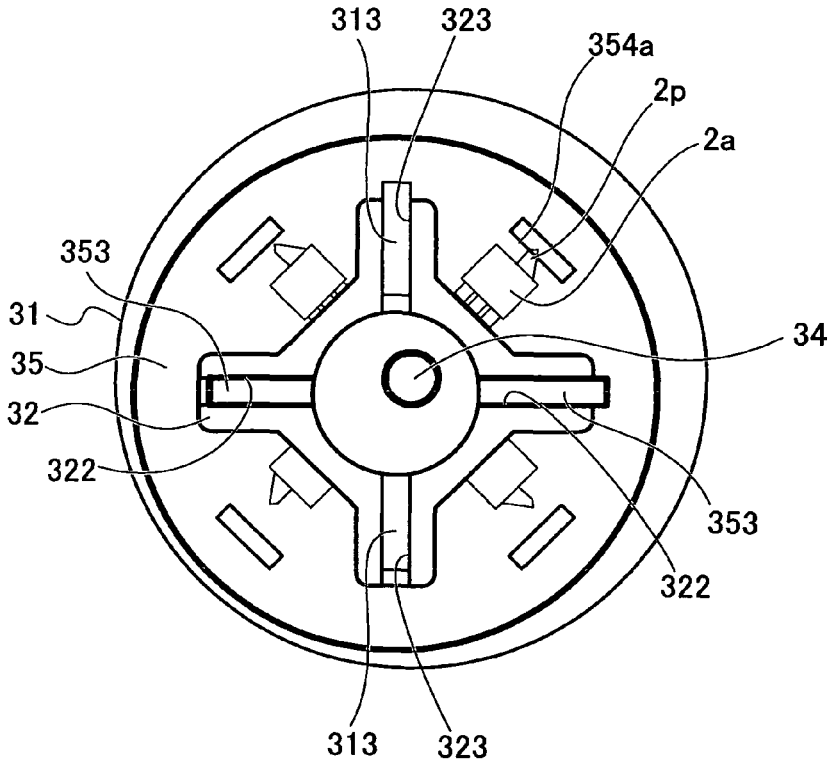
FIG. 13 is a schematic view in which the pad has moved by sliding in a diagonally left lower direction from the position in FIG. 4.

Finally, in a case where the dial 421 is operated to slide it from the position as shown in FIG. 2 in the diagonally left lower direction h, the pad 35 moves, as shown in FIGS. 4 and 13, to the diagonally lower side in a state in which, while pushing the supporting pin 34, the two lower rail parts 323 of the sliding section 32 are guided by the two rail parts 313 of the base 31.

When the pad 35 moves to the diagonally left lower side as shown in FIG. 13, the switch pushing part 354*a* on the right upper side of the pad 35 pushes the tip 2*p* of the push switch 2*a* on the right upper side of the first substrate 2, whereby this push switch 2*a* is switched on. When the state in which the supporting pin 34 is pushed by the pad 35 is released, the spring 33 returns to the original state, and the pad 35 returns to the neutral position as shown in FIG. 4.

As described hereinabove, according to the multidirectional operation switch apparatus 1 of this embodiment, as many as eight different kinds of switch-on operations are possible by sliding the pad 35 in eight directions. In addition, in this apparatus 1, the pad 35 constituting the mechanism unit 3 is provided with switch pushing parts 354*a*-354*d* which are related to the sliding operation. Therefore, as compared with a multidirectional operation switch apparatus in which the sliding section 32 is provided with switch pushing parts, the switch-on operation of each of the switch pushing parts can be effected directly. Therefore, there is no possibility of delay in the timing of switching on each of the push switches 2*a*-2*d*. As a result, the multidirectional operation switch apparatus 1 of this invention can improve the operator's satisfaction with the switch-on operability of each of the switch pushing parts.

Although not illustrated, as a modified example of the multidirectional operation switch apparatus 1 of this embodiment, the mechanism unit 3 may be provided with two metallic plates. More specifically, each of the metallic plates is disposed, with reference to FIG. 3, between the damper 36 and the base cover 37 as well as between the sliding section 32 and the base 31. The multidirectional operation switch apparatus thus provided with the two metallic plates can reduce the sliding resistance at the time of sliding operation, resulting in an improved feeling of operating the apparatus.

In the multidirectional operation switch apparatus 1 according to the embodiment of this invention, the upper and lower rail parts 322, 323 of the sliding section 32 are formed into grooves. They may, however, be formed into projections. In order to cope with this modification, the two rail parts 313 of the base 31, as well as the two rail parts 353 of the pad 35, both corresponding to these upper and lower rail parts 322, 323, may be formed into grooves. Further, although the two rail parts 313 of the base 31 and the two lower rail parts 323 of the sliding section 32 are disposed so as to be elongated in the Y direction, they may be disposed so as to be elongated in the X direction. In order to comply with this modification, the two rail parts 353 of the pad 35 as well as the two upper rail parts 322 of the sliding section 32 may be disposed so as to be elongated in the Y direction.

In the multidirectional operation switch apparatus 1 according to the embodiment of this invention, descriptions were made about an example capable of operation by sliding in eight directions. It is to be noted, however, that an embodiment which is capable of operation by sliding in at least X and Y directions (four directions) will also be able to improve the feeling of operating the apparatus in the same manner as in this embodiment.

According to this invention, the sliding section is made in a thin plate. According to this arrangement, the overall height of the apparatus can be reduced. Therefore, it becomes possible to constitute a larger and multifunctional operation unit within a limited housing space. In this manner, the apparatus of this invention can attain a dual purpose of space saving and increased functionality.

Furthermore, the upper rail part and the lower rail part of the sliding section of the apparatus of this invention are formed into grooves. Therefore, the overall height of the apparatus can be kept smaller, attaining the downsizing of the apparatus.

Still furthermore, the pad of the apparatus of this invention comprises a plurality of switch pushing parts for switching on the push switches by a sliding movement of the pad. In this manner, the switch-on of the push switches is directly performed, as compared with the conventional multidirectional operation switch apparatus in which the switch pushing parts are disposed on the sliding section. Therefore, there is no possibility in that the timing of switching on the push switches delays. The apparatus of this invention can improve the feeling of switch-on operation of the switches.

As described so far, the operability can be improved with the multidirectional operation switch apparatus according to this invention. Therefore, this apparatus can well be utilized in the technical field of multidirectional operation switch apparatuses.

Although a particular preferred embodiment of the invention has been disclosed in detail for illustrative purposes, it will be recognized that variations or modifications of the disclosed apparatus, including the rearrangement of the constituent elements, lie within the scope of this invention.

What is claimed is:

1. A multidirectional operation switch apparatus comprising: a first substrate having disposed thereon a plurality of push switches; and an operation unit supported on an upper surface of the first substrate through a mechanism unit so as to be slidable in X, Y directions, the push switches being so arranged as to be switched on by a push movement of the operation unit, wherein the mechanism unit comprises: a second substrate having disposed thereon a rotary switch which is rotatable by the operation unit clockwise or counterclockwise; a pad for fixedly supporting the second substrate; and a base fixed to the first substrate, the base supporting the pad through a sliding section, and wherein the sliding section is formed of a single member and comprises: an upper rail part disposed on an upper surface of the sliding section; and a lower rail part disposed on a lower surface of the sliding section, the upper rail part slidably moving the pad in one of the X, Y directions, and the lower rail part slidably moving the pad on an upper surface of the base in the other of the X, Y directions.

2. The multidirectional operation switch apparatus according to claim 1, wherein the sliding section is made of a thin plate.

3. The multidirectional operation switch apparatus according to claim 2, wherein the upper rail part and the lower rail part of the sliding section are formed into grooves.

4. The multidirectional operation switch apparatus according to claim 1, wherein the pad comprises a plurality of switch pushing parts for switching on the push switches by a sliding movement of the pad.

* * * * *